US008534667B2

(12) United States Patent
Cha

(10) Patent No.: US 8,534,667 B2
(45) Date of Patent: Sep. 17, 2013

(54) APPARATUS TO ALIGN MEDIA

(75) Inventor: Jin Hwan Cha, Anyang-si (KR)

(73) Assignee: Nautilus Hyosung Inc., Seoul (KR)

( * ) Notice: Subject to any disclaimer, the term of this patent is extended or adjusted under 35 U.S.C. 154(b) by 0 days.

(21) Appl. No.: 13/560,179

(22) Filed: Jul. 27, 2012

(65) Prior Publication Data

US 2013/0032995 A1 Feb. 7, 2013

(30) Foreign Application Priority Data

Aug. 2, 2011 (KR) ..... 10-2011-0076945

(51) Int. Cl.
*B65H 7/02* (2006.01)
*B65H 9/16* (2006.01)

(52) U.S. Cl.
USPC ..... 271/228; 271/250; 271/251

(58) Field of Classification Search
USPC ..... 271/227, 228, 250, 251
See application file for complete search history.

(56) References Cited

U.S. PATENT DOCUMENTS

| | | | | |
|---|---|---|---|---|
| 5,156,392 | A * | 10/1992 | Wong et al. | 271/251 |
| 5,657,983 | A * | 8/1997 | Fisk | 271/251 |
| 5,697,609 | A * | 12/1997 | Williams et al. | 271/228 |
| 6,273,418 | B1 * | 8/2001 | Fujikura et al. | 271/228 |
| 2007/0023995 | A1 * | 2/2007 | Onodera | 271/226 |
| 2007/0108699 | A1 * | 5/2007 | Heemskerk | 271/250 |
| 2010/0102504 | A1 * | 4/2010 | Yasumoto | 271/251 |
| 2010/0327518 | A1 * | 12/2010 | Tharayil | 271/227 |
| 2011/0042887 | A1 * | 2/2011 | Kallin et al. | 271/227 |

* cited by examiner

*Primary Examiner* — David H Bollinger
(74) *Attorney, Agent, or Firm* — Fenwick & West LLP

(57) ABSTRACT

A medium alignment apparatus may include an alignment body to form a transfer path is formed for passage of a medium and include an alignment reference surface for alignment of the medium is formed, an alignment roller portion mounted to the alignment body to align the medium while driving the medium simultaneously, and at least one alignment sensor portion to detect whether the medium is aligned by detecting a position of the medium passing along the transfer path. The alignment body may include a first body forming a transfer path for the medium, to which the alignment roller portion is mounted, and a second body disposed at one side of the first body to be movable relative to the first body at a speed corresponding to a transfer speed of the medium, providing a side directed to the first body as the alignment reference surface.

12 Claims, 8 Drawing Sheets

APPARATUS TO ALIGN MEDIA

CROSS-REFERENCE TO RELATED APPLICATION

This application claims the benefit of Korean Patent Application No. 10-2011-0076945, filed on Aug. 2, 2011, in the Korean Intellectual Property Office, the disclosure of which is incorporated herein by reference.

BACKGROUND

1. Field of the Invention

The present invention relates to a medium alignment apparatus, and more particularly, to a medium alignment apparatus correctly detecting an aligned state of a medium when performing alignment of the medium, thereby increasing reliability in alignment.

2. Description of the Related Art

Generally, an automatic teller machine (ATM) refers to an automated apparatus providing fundamental monetary services, such as payment and withdrawal of cash and checks, using a card or a bankbook regardless of time and places without a bank teller.

Recently, use of the ATM is not limited to banking facilities such as banks but expanded to convenience stores, department stores, and other public places.

The ATM may be classified into a cash dispenser, a cash receiver, and a cash dispenser and receiver. In these days, the ATM is used for not only payment and withdrawal of cash but also payment and withdrawal of checks, bankbook arrangement, fee payment by giro, ticketing, and the like.

Nowadays, the cash receiver among the foregoing types is applying a technology for receiving different types of paper medium, such as cash and checks, together rather than separately.

A structure of the ATM as the cash receiver will be briefly described. The ATM may include a housing to form a main body, a medium receiving portion to receive a paper medium such as cash and checks, a medium transfer portion including a plurality of rollers to transfer the paper medium received through the medium receiving portion, a medium detection portion mounted on a path of the medium transfer portion to detect whether the paper medium includes double sheets, a medium recognition portion to recognize data of the paper medium, a medium alignment portion to align the paper medium before the paper medium is delivered to the medium recognition portion, a temporary stack portion to temporarily store the received paper medium, a retract portion to retract a non-received paper medium among the paper medium, a reject portion to store a paper medium detected to be abnormal by the medium detection portion and rejected, and a cassette portion to finally store the received paper medium. The cassette may include a cash cassette to store only cash and a check cassette to store only checks.

According to the foregoing structure, the paper medium may be received through the medium receiving portion and transferred to the respective corresponding cassettes, passing through the temporary stack portion by the medium transfer portion.

The medium alignment portion is adapted to align a paper medium of different sizes and types, for example cash and checks having different widths and lengths from each other, with reference to one side so that the paper medium is transferred in an aligned state. In particular, by aligning checks, the medium alignment portion helps correctly acquire data of the checks.

However, in the conventional ATM used as the cash receiver, an error may occur when the medium alignment portion detects an aligned state of a medium. Therefore, when a non-aligned paper medium is transferred to a next step from the medium alignment portion, recognition of the medium may not be normally performed. Consequently, reliability of a cash receiving operation may be reduced.

Accordingly, there is a desire for an improved medium alignment apparatus and an ATM including the medium alignment apparatus, capable of correctly detecting an aligned state of a paper medium.

SUMMARY

An aspect of the present invention provides a medium alignment apparatus reliably performing alignment of a paper medium by correctly detecting an aligned state of a medium such as a paper medium by an alignment sensor portion.

Another aspect of the present invention provides a medium alignment apparatus accurately aligning a mixed paper medium including cash and checks of different sizes and types with respect to an alignment reference surface.

Still another aspect of the present invention provides a medium alignment apparatus in which a detection operation of an alignment sensor portion is secured irrespective of operations of other structures such as an alignment body or an alignment roller portion.

According to an aspect of the present invention, there is provided a medium alignment apparatus including an alignment body to form a transfer path for passage of a medium and include an alignment reference surface for alignment of the medium, an alignment roller portion mounted to the alignment body to align the medium while driving the medium simultaneously, and at least one alignment sensor portion to detect whether the medium is aligned by detecting a position of the medium passing along the transfer path. The alignment body may include a first body forming a transfer path for the medium, to which the alignment roller portion is mounted, and a second body disposed at one side of the first body to be movable relative to the first body at a speed corresponding to a transfer speed of the medium, while providing a side directed to the first body as the alignment reference surface. Accordingly, an aligned state of the medium such as a paper medium may be correctly detected, thereby increasing reliability in alignment of the paper medium. In addition, a mixed paper medium including cash and checks of different sizes and types may be accurately aligned with respect to the alignment reference surface. Therefore, correct operations including recognition of the medium may be achieved.

The first body may have a cylindrical shape and the second body may have a diameter greater than a diameter of the first body, thereby providing an alignment reference surface, and the second body may be rotatable relative to the first body corresponding to the transfer speed of the medium.

The at least one alignment sensor portion may detect whether the medium is aligned, by receiving and transmitting a detection signal using a prism principle.

The since alignment sensor portion may include a transmission member disposed at one side of the second body providing the alignment reference surface and configured to emit the detection signal toward the alignment reference surface; and a reflection member disposed at an opposite side of the second body, facing the transmission member, with respect to the alignment reference surface and configured to reflect the detection signal.

The second body providing the alignment reference surface may include at least one part made of a transparent material to allow passage of the detection signal of the at least one alignment sensor portion, and one of the transmission member and the reflection member may be disposed at an outside and the other one may be disposed at an inside with respect to the second body providing the alignment reference surface.

The transmission member may be disposed at the outside of the second body and the reflection member may be disposed at the inside of the second body.

The reflection member may be a prism type configured to reflect the detection signal emitted from the transmission member back to the transmission member, and the reflection member may include a first reflection surface to divert the detection signal emitted from the transmission member into a vertical direction and a second reflection surface to divert the detection signal reflected from the first reflection surface back to the transmission member.

The reflection member may further include an extension part which guides the detection signal reflected from the second reflection surface, and the extension part may be extended in a direction to the transmission member.

The first body may have a cylindrical shape and the second body may have a diameter greater than a diameter of the first body, thereby providing an alignment reference surface, and the second body may be rotatable relative to the first body corresponding to the transfer speed of the medium.

The at least one alignment sensor portion may include a transmission member disposed at an outside of the alignment body providing the alignment reference surface and configured to emit the detection signal toward the alignment reference surface; and a reflection member integrally formed with the alignment body which faces the transmission member with respect to the alignment reference surface and configured to reflect the detection signal, wherein the reflection member may be a prism type configured to reflect the detection signal emitted from the transmission member back to the transmission member.

An aligned state of the medium may be detected when the detection signal emitted from the transmission member is blocked by the medium and not reflected since the medium is aligned with respect to the alignment reference surface, and a non-aligned state of the medium may be detected when the detection signal emitted from the transmission member is reflected by the reflection member and received to the transmission member since the medium is not aligned with respect to the alignment reference surface.

At least one alignment sensor portion may include two alignment sensor portions arranged in a same direction as the transfer direction of the medium, and the medium is determined to be aligned when both of the two alignment sensors detect the medium.

The alignment roller portion may include a plurality of driving rollers disposed in the alignment body to drive the medium forward along the transfer path; a plurality of inclined rollers disposed at an outside of the alignment body to correspond to the plurality of driving rollers, and selectively inclined with respect to a transfer direction of the medium; and an inclination adjustment portion to adjust an inclination of the plurality of inclined rollers with respect to the driving rollers based on detected information of the alignment sensor portion.

According to embodiments of the present invention, alignment of a paper medium may be reliably performed since an alignment sensor portion correctly detects an aligned state of a medium such as a paper medium.

Additionally, according to embodiments of the present invention, a mixed paper medium including cash and checks of different sizes and types may be accurately aligned with respect to the alignment reference surface. Therefore, operations such as medium recognition may be correctly performed.

Furthermore, according to embodiments of the present invention, a detection operation of an alignment sensor portion may be securely performed irrespective of operations of other structures such as an alignment body or an alignment roller portion.

BRIEF DESCRIPTION OF THE DRAWINGS

These and/or other aspects, features, and advantages of the invention will become apparent and more readily appreciated from the following description of exemplary embodiments, taken in conjunction with the accompanying drawings of which.

DETAILED DESCRIPTION

Hereinafter, structure and application of embodiments of the present invention will be described in detail with reference to the accompanying drawings. The following description illustrates one of various aspects of the present invention and constitutes part of a detailed description about the present invention.

However, in explaining the embodiments of the present invention, generally known functions and structures will not be explained in detail for conciseness.

In the following description, a medium alignment apparatus installed in an automatic teller machine (ATM) to align a medium, for example a paper medium including cash and checks of different sizes and types, will be described. However, application of the medium alignment apparatus is not limited thereto. For example, the medium alignment apparatus may be applied to align printed objects, flat substrates, and the like.

Prior to explanation of the medium alignment apparatus according to an embodiment of the present invention, a structure of an ATM to which the medium alignment apparatus is applicable will be briefly described with reference to FIG. 1.

Figure 1:
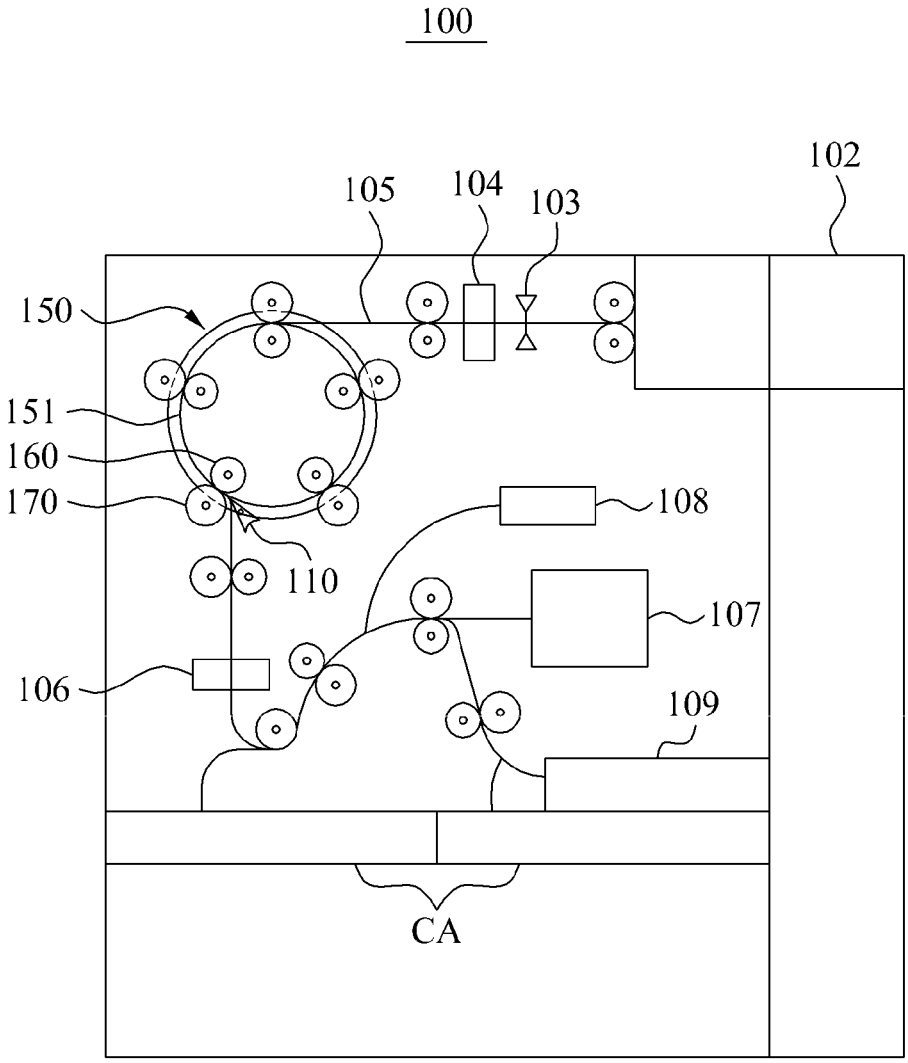
FIG. 1 is a view illustrating a structure of an automatic teller machine (ATM) according to an embodiment of the present invention.

FIG. 1 is a view illustrating a structure of an ATM 100 according to an embodiment of the present invention.

Referring to FIG. 1, the ATM 100 includes a medium receiving portion 102 configured to receive a paper medium P mixedly including cash and checks, a medium transfer portion 105 configured to form a transfer path for the received paper medium P, a medium detection portion 103 to detect whether the paper medium P includes double sheets, a medium recognition portion 104 to recognize whether the paper medium P is cash or a check, a medium alignment apparatus 150 disposed in the medium transfer portion 105 to align sheets of the paper medium P being transferred along the transfer path of the medium transfer portion 105, a check recognition portion 106 to recognize data of checks included in the paper medium P, a temporary stack portion 107 to temporarily store the paper medium P, and a cassette (CA) to store a finally received paper medium P. In addition, the ATM 100 may further include a reject portion 108 to store a paper medium P determined to be abnormal by the medium recognition portion 104 and rejected, and a retract portion 109 to retract a paper medium P which is recognized as a paper medium to be retracted by the medium recognition portion 104.

According to the aforementioned structure, while the paper medium P received through the medium receiving portion 102 is being transferred along the transfer path of the medium transfer portion 105, the paper medium P may be aligned by the medium alignment apparatus 150 and data of the paper medium P may be recognized by the medium recognition portion 104 and the check recognition portion 106. Next, the paper medium P may be transferred to and stored in respectively corresponding CAs, for example, a cash CA or a check CA. Otherwise, when the paper medium P is detected to be abnormal, the paper medium P may be transferred to the reject portion 108 or the retract portion 109.

To transfer the paper medium P selectively to the CAs, the reject portion 108, or the retract portion 109, correct recognition of the paper medium P is required. For this, whether the paper medium P is accurately aligned needs to be correctly recognized. Therefore, the ATM 100 may employ the medium alignment apparatus 150 according to the embodiment of the present invention. Hereinafter, the medium alignment apparatus 150 will be described with reference to the accompanying drawings.

Figure 2:
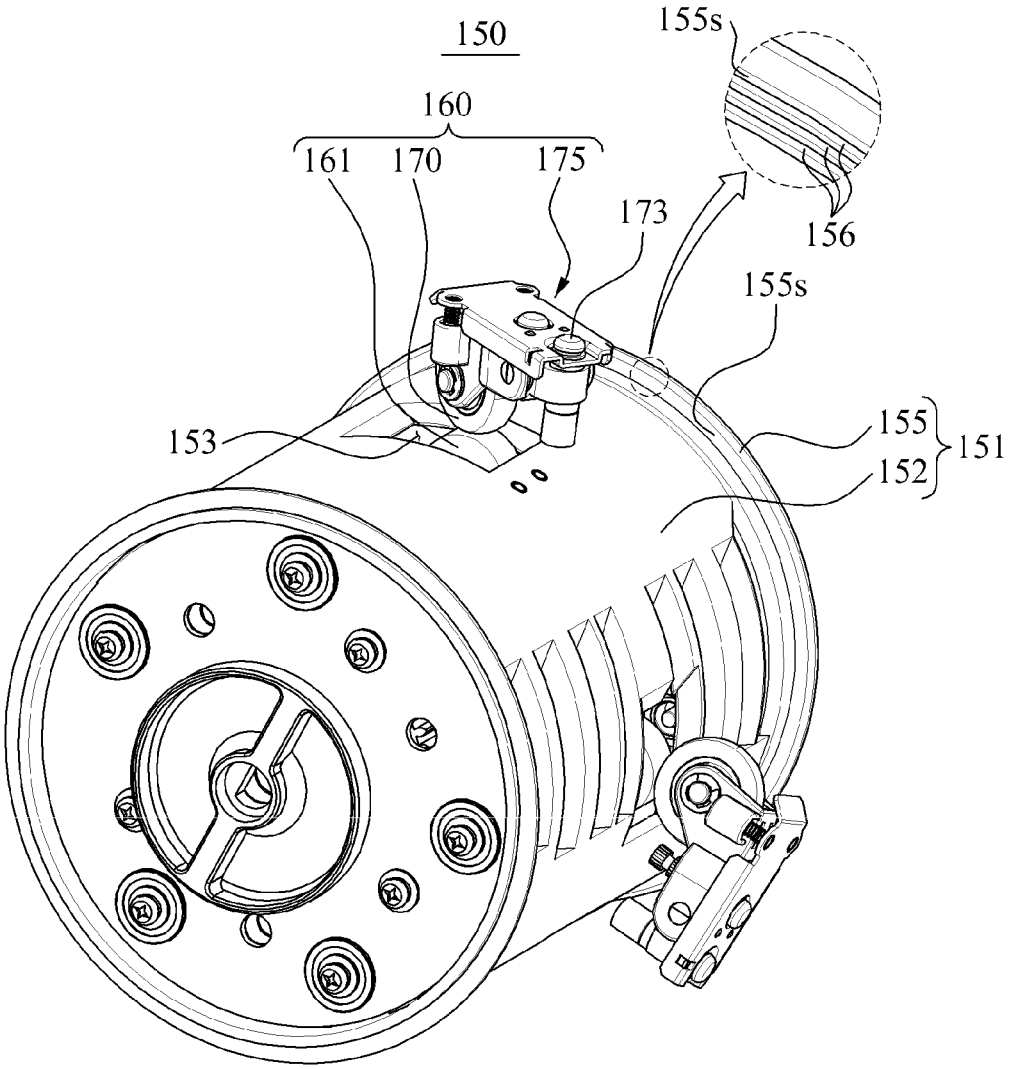
FIG. 2 is a partially exploded and perspective view illustrating a medium alignment apparatus shown in FIG. 1.
Figure 3:
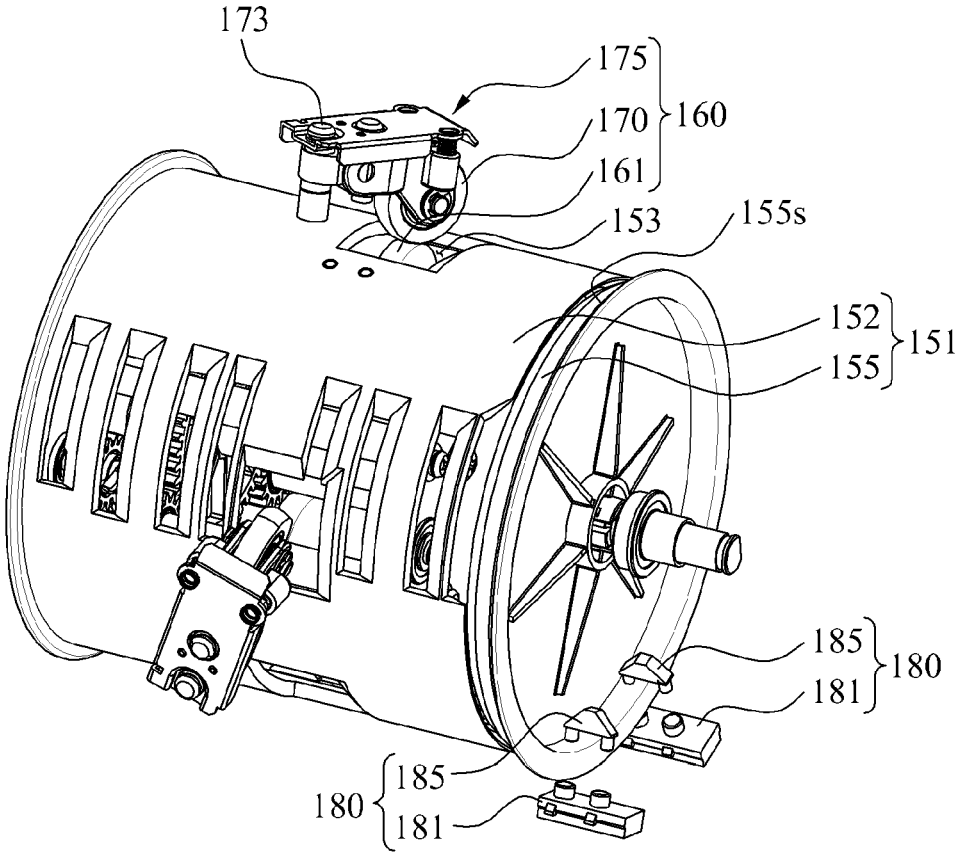
FIG. 3 is a view of FIG. 2 seen from another view, illustrating a mounting state of an alignment sensor portion shown in FIG. 2.
Figure 4:
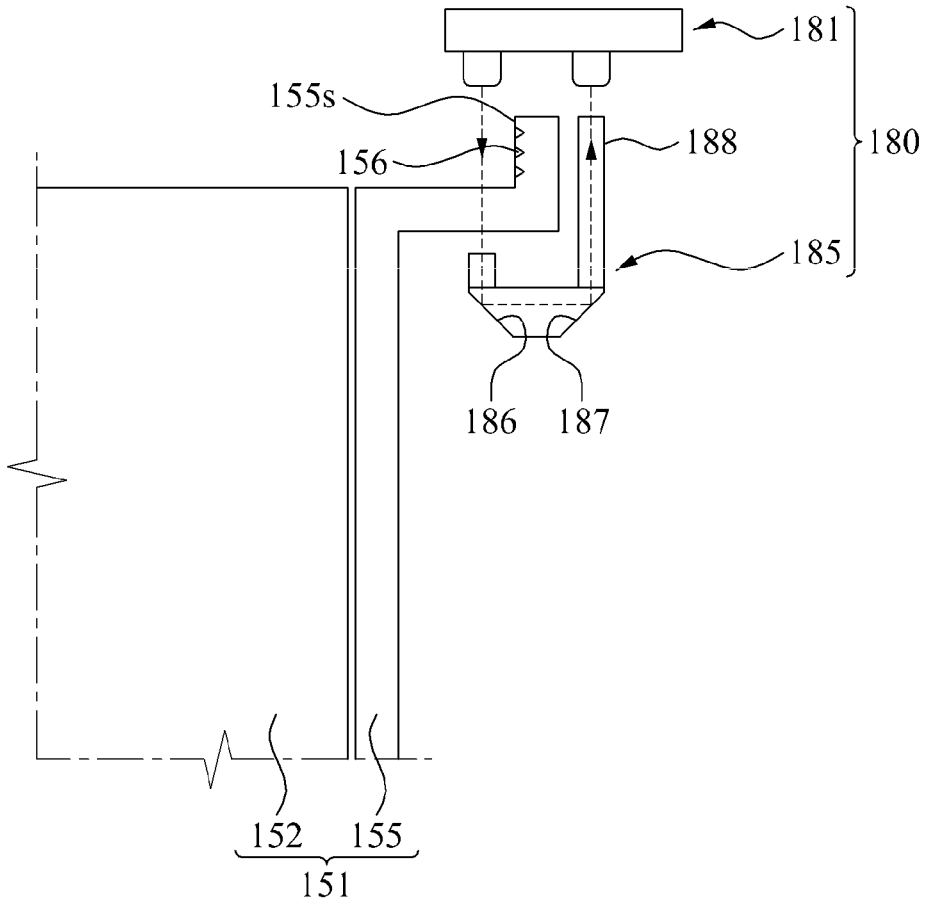
FIG. 4 is a diagram illustrating part of the alignment sensor portion and an alignment body shown in FIG. 3.
Figure 5:
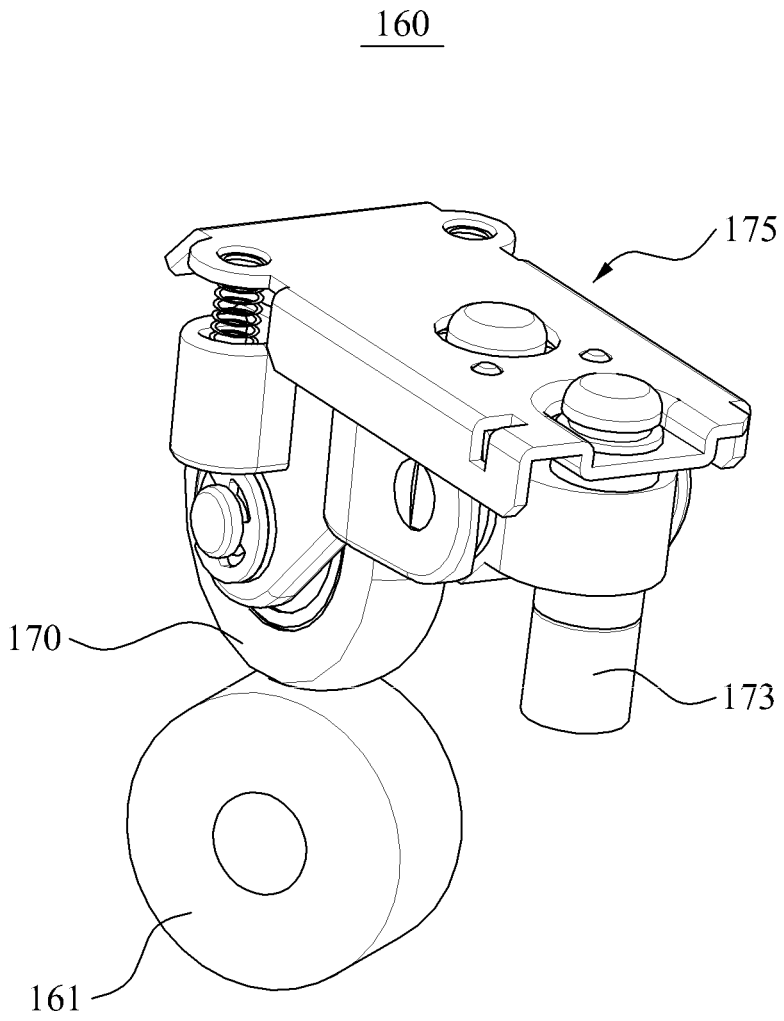
FIG. 5 is a perspective view illustrating a structure of an alignment roller portion shown in FIGS. 2 and 3.

FIG. 2 is a partially exploded and perspective view illustrating the medium alignment apparatus 150 shown in FIG. 1. FIG. 3 is a view of FIG. 2 seen from another view, illustrating a mounting state of an alignment sensor portion 180 shown in FIG. 2. FIG. 4 is a diagram illustrating part of the alignment sensor portion 180 and an alignment body 151 shown in FIG. 3. FIG. 5 is a perspective view illustrating a structure of an alignment roller portion 160 shown in FIGS. 2 and 3.

As shown in FIGS. 2 and 3, the medium alignment apparatus 150 may include a drum-type alignment body 151 providing a transfer path connected to the transfer path of the medium transfer portion 105 and including an alignment reference surface 155*s* for alignment of the paper medium, the alignment roller portion 160 mounted to the alignment body 151 to drive the paper medium P while simultaneously aligning the paper medium P, and the alignment sensor portion 180 to detect whether the paper medium P is aligned, by detecting a position of the paper medium P passing along the transfer path of the alignment body 151. The alignment sensor portion 180 may accurately detect the aligned state of the paper medium P by receiving and transmitting a detection signal using a prism principle, which will be described in details later.

According to the structure of the medium alignment apparatus 150, whether the paper medium P is aligned may be correctly detected, thereby achieving reliable alignment of the paper medium P. Also, since the paper medium P mixedly including cash and checks of different sizes and types is accurately aligned with respect to the alignment reference surface 155*s*, operations such as medium recognition may be correctly performed.

The respective elements will be described. The alignment body 151, forming the transfer path for the paper medium P to be aligned, may be connected to the transfer path of the medium transfer portion 105. The alignment body 151 may be provided in a drum shape around which the paper medium P may rotate along the transfer path. That is, when the paper medium P introduced to the medium alignment apparatus 150 is not aligned while rotating around the transfer path, the paper medium P may be rotated around the transfer path again to be aligned and then transferred to a next step.

Thus, when the alignment body 151 is the drum type, size of the alignment body 151 may be reduced, accordingly reducing an installation space. However, the shape of the alignment body 151 is not limited to the drum type. For example, the alignment body 151 may have a flat upper surface to form a linear transfer path.

In further details, referring to FIGS. 2 and 3, the alignment body 151 may include a first body 152 forming the transfer path and to which the alignment roller portion 160 is mounted, and a second body 155 extruded outward from one side of the first body 152, thereby providing the alignment reference surface 155*s* for the paper medium P.

As shown in FIGS. 2 and 3, when the paper medium P is transferred to an outer surface of the first body 152 to which the first body 152 is mounted, the paper medium P may be driven while being aligned by operation of the alignment roller portion 160.

The first body 152 may have a circumference a bit longer than a length of one sheet of the paper medium P so that alignment of one sheet of the paper medium P is achieved by the medium alignment apparatus 150. However, not limited thereto, the first body 152 may be configured so that plural sheets of the paper medium P are sequentially introduced in the medium alignment apparatus 150 and aligned.

As shown in FIGS. 2 and 3, the second body 155 may be rotatably connected to a side of the first body 152, providing the alignment reference surface 155*s* for alignment of the paper medium P. That is, a side of the second body 155 directed to the first body 152 serves as the alignment reference surface 155*s*. Therefore, the paper medium P may be aligned with reference to the alignment reference surface 155*s* during transfer and therefore transferred in the aligned state to a next step, for example the medium recognition portion 106.

Whereas the first body 152 is fixed to an inside of the ATM 100, the second body 155 is rotatable with respect to the first body 152. According to such a structure, when the paper medium P is aligned with respect to the alignment reference surface 155*s* of the second body 155 by the alignment roller portion 160 and then driven along the outer surface of the first body 152, creasing or tearing of the paper medium P may be prevented.

After the paper medium P is aligned, the paper medium P stays in contact with the alignment reference surface 155*s* of the second body 155. Here, since the second body 155 rotates with respect to the first body 152 at almost the same speed as a speed of the paper medium P driven by the alignment roller portion 160, friction may be prevented from generating between the paper medium P and the alignment reference surface 155*s*. As a result, creasing or tearing of the paper medium P may be prevented.

Furthermore, as shown in the partial enlarged view of FIG. 2, a plurality of grooves 156 may be formed in the form of bands along a circumference of the alignment reference surface 155*s*. When the paper medium P is aligned with respect to the alignment reference surface 155*s*, the grooves 156 may prevent folding of one side of the paper medium P which first touches the alignment reference surface 155*s*. Consequently, reliability in the alignment may be increased.

The alignment roller portion 160 is mounted to the alignment body 151 to actually align the paper medium P while driving the paper medium P. As shown in FIGS. 2 and 5, the alignment roller portion 160 may include a plurality of driving rollers 161 disposed inside the first body 152 to drive the paper medium P forward along the transfer path, a plurality of inclined rollers 170 disposed outside the first body 152 corresponding to the plurality of driving rollers 161, respectively, and selectively inclined with respect to a transfer direction of the paper medium P, and an inclination adjustment member 175 configured to adjust an inclination of the inclined rollers 170 based on information detected by detection sensors of the alignment sensor portion 180 that will be described later.

As briefly shown in FIGS. 1 to 3, the driving rollers 161 may be plural in number, for example five, and uniformly arranged along an inner circumference of the first body 152. The driving rollers 161 may be partially exposed through holes 153 formed at the first body 152. Therefore, when the paper medium P is driven by the driving rollers 161 on the first body 152, stoppage of the paper medium P may be restricted.

The driving rollers 161 may be rotated by respectively corresponding driving motors (not shown). Accordingly, the driving rollers 161 may be rotated at almost the same speed as one another when driving the paper medium P forward. As a result, creasing of the paper medium P that may be caused by different speeds among the driving rollers 161 may be prevented. Although the driving rollers 161 are described to be independently driven by the respective driving motors in the present embodiment, the structure is not limiting. That is, the plurality of driving rollers 161 may be driven by a single driving motor.

As shown in FIGS. 2 and 3, the inclined rollers 170 may be disposed at the outside of the first body 152 to correspond to the driving rollers 161. Different from the driving rollers 161 rotated in the transfer direction of the paper medium P, the inclined rollers 170 may be rotated in a direction inclined from the transfer direction of the paper medium P.

That is, the inclined rollers 170 may push the paper medium P against the alignment reference surface 155*s* of the second body 155 so that the paper medium P being driven by the driving rollers 161 is moved to one side, that is, the alignment reference surface 155*s*. Thus, the inclined rollers 170 may actually perform alignment of the paper medium P.

The inclined rollers 170 may partially contact with an outer surface of the driving rollers 161 and therefore rotate in a direction opposite to a rotation direction of the driving rollers 161 as the driving rollers 161 rotate. By a rotational force, the inclined rollers 170 may push the paper medium P toward the alignment reference surface 155*s* of the second body 155. However, the inclined rollers 170 may each be provided with a driving portion (not shown) to rotate the inclined rollers.

When the inclined rollers 170 continues pushing the paper medium P being driven by the driving rollers 160 in the inclined direction, for example, when the inclined rollers 170 continues pushing even after the paper medium P is aligned with respect to the alignment reference surface 155*s*, interference may be caused between the paper medium P and the alignment reference surface 155*s*, thereby causing creasing or tearing of the paper medium P.

To prevent the foregoing situation, the medium alignment apparatus 150 may further include the inclination adjustment member 175 to adjust the inclination of the inclined rollers 170 based on information detected by the alignment sensor portion 180.

The inclination adjustment member 175 may adjust the inclination of the inclined rollers 170 with respect to a driving direction of the driving rollers 161, by rotating the inclined rollers 170 about a rotational shaft 173 base on the information of the alignment sensor portion 180. As will be described in detail, during alignment of the paper medium P, the inclination adjustment member 175 may adjust the inclined rollers 170 to be inclined with respect to the driving rollers 161 so that the paper medium P is moved toward the alignment reference surface 155*s*. When the alignment is completed, the inclination adjustment member 175 may adjust the inclined rollers 170 to be in the same direction as the driving direction of the driving rollers 161, so that the paper medium P is not pushed toward the alignment reference surface 155*s*.

However, although a mounting structure of the inclination adjustment member 175 is not specifically shown, a mounting housing (not shown) may be provided at an upper part of the alignment body 151. The inclination adjustment portion 175 coupled with the inclined rollers 170 may be mounted to the mounting housing to be able to operate.

Thus, according to the present embodiment, since the operation of the alignment roller portion 160 is determined based on the detected information of the alignment sensor portion 180, the alignment sensor portion 180 needs to correctly obtain the detected information related to the aligned state of the paper medium P.

Therefore, as shown in FIG. 4, the medium alignment apparatus 150 may include at least one alignment sensor portion 180 disposed adjacent to the alignment reference surface 155*s* to accurately determine the aligned state of the paper medium P. In the present embodiment, two alignment sensor portions 180 are provided.

Here, the two alignment sensor portions 180 may be arranged collinearly with respect to the rotational direction of the alignment body 151, to detect whether the paper medium P is accurately aligned with respect to the alignment reference surface 155*s*. For example, when one of the alignment sensor portions 180 detects the paper medium P contacting the alignment reference surface 155*s* and the other one detects the paper medium P not contacting the alignment reference surface 155*s*, it is determined that alignment of the paper medium P is not completed. Therefore, the alignment may be further performed by the alignment roller portion 160. That is, when both of the two alignment sensor portions 180 detect the paper medium P contacting the alignment reference surface 155*s*, it is determined that the paper medium P is aligned.

The structure of the alignment sensor portion 180 will be described. As shown in FIGS. 3 and 4, the alignment sensor portion 180, being configured to receive and transmit the detection signal using a prism principle, may include a transmission member 181 disposed at one side of the second body 155, that is, an upper part of the second body 155 in FIG. 4, to emit the detection signal toward the alignment reference surface 155*s* which contacts one side of the paper medium P, and a reflection member 185 disposed at an opposite side of the second body, that is, a lower part of the second body 155 in FIG. 4, which faces the transmission member 181 with respect to the alignment reference surface 155*s* to reflect the detection signal back to the transmission member 181. The second body 155 may be made of a transparent material so that the detection signal of the alignment sensor portion 180 may transmit.

Although not shown, the transmission member 181 and the reflection member 185 of the alignment sensor portion 180 may be fixed to the mounting housing enclosing the alignment body 151. Therefore, irrespective of rotation of the second body 155 of the alignment body 151 or the operation of the alignment roller portion 160, the detected information of the alignment sensor portion 180 may be stably and correctly obtained.

As aforementioned, the alignment sensor portion 180 may obtain the detected information using the prism principle. In details, since the reflection member 185 of the alignment sensor portion 180 has a prism structure, a signal emitted from the transmission member 181 toward the alignment reference surface 155*s* that aligns the paper medium P may return to the transmission member 181 by the reflection member 185.

As shown in FIG. 4, the reflection member 185 may include a first reflection surface 186 configured to divert the signal emitted from the transmission member 181 toward the alignment reference surface 155*s* into a vertical direction, and a second reflection surface 187 configured to divert the signal reflected by the reflection surface 186 back to the transmission member 181. In addition, the reflection member 185 may further include an extension part 188 which guides the signal reflected from the second reflection surface 187. The extension part 188 may be extended toward the transmission member 181 so that the signal reflected from the reflection member 185 is delivered accurately to the transmission member 181 without being diffused by external surroundings such as the air.

Therefore, when the signal emitted from the transmission member 181 is received back to the transmission member 171, this means that the paper medium P is not disposed at the alignment reference surface 155*s*. That is, the paper medium P is not aligned. Conversely, when the signal emitted by the transmission member 181 is not received to the transmission member 181, this means that the paper medium P is disposed at the alignment reference surface 155*s*. That is, the paper medium P is aligned with respect to one of the alignment sensor portions 180.

However, as aforementioned, the alignment of the paper medium P is determined to be completed when both of the alignment sensor portions 180 detect the paper medium P disposed at the alignment reference surface 155*s*. Next, the paper medium P may be delivered to a next step, that is, the medium transfer portion 105, by a gate 110 shown in FIG. 1, which determines the transfer direction of the paper medium P.

Besides the alignment sensor portion 180, at least two sensors (not shown) to detect a skew angle of the paper medium P may be included in the medium alignment apparatus 150.

The sensors may be arranged collinearly on the first body 152 and orthogonally to the transfer direction of the paper medium P. The at least two sensors detect the skew angle of the paper medium P, thereby determining whether the paper medium P is aligned. Information detected by the sensors may be transmitted to a control portion so that the inclination is adjusted by the inclination adjustment member 175.

Here, width of the at least two detection sensors (not shown) detecting the skew angle of the paper medium P may be smaller than a smallest width of the paper medium P passing through the medium alignment apparatus 150. Therefore, the aligned state of all the paper medium P passing through the medium alignment apparatus 150 may be correctly recognized.

Hereinafter, driving of the alignment roller portion 160 depending on detection of the alignment sensor portion 180 will be described with reference to FIGS. 6A and 6B.

Figure 6A:
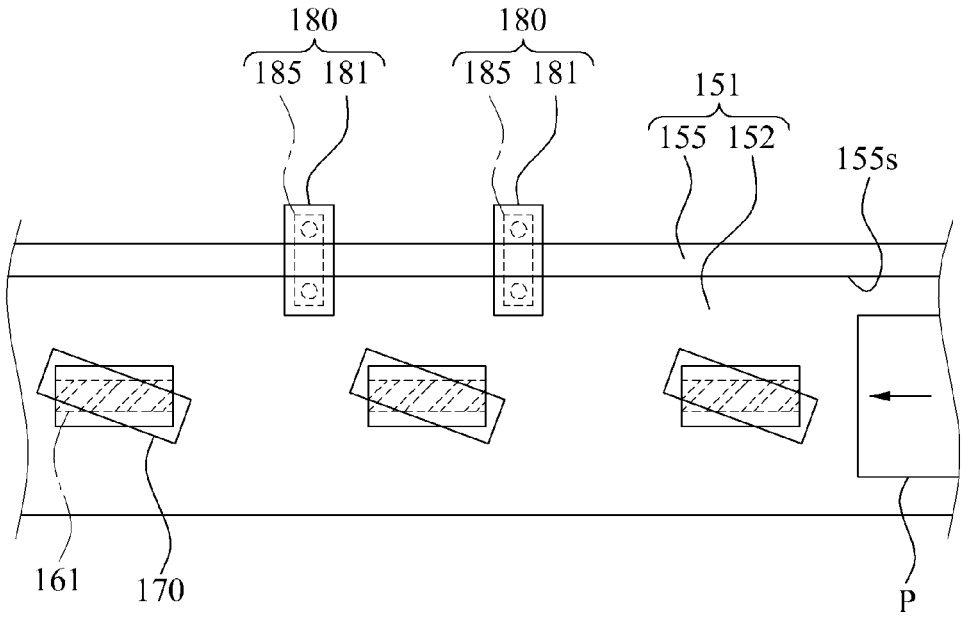
FIGS. 6A and 6B are diagrams illustrating a process of aligning a paper medium by the alignment roller portion shown in FIG. 2.
Figure 6B:
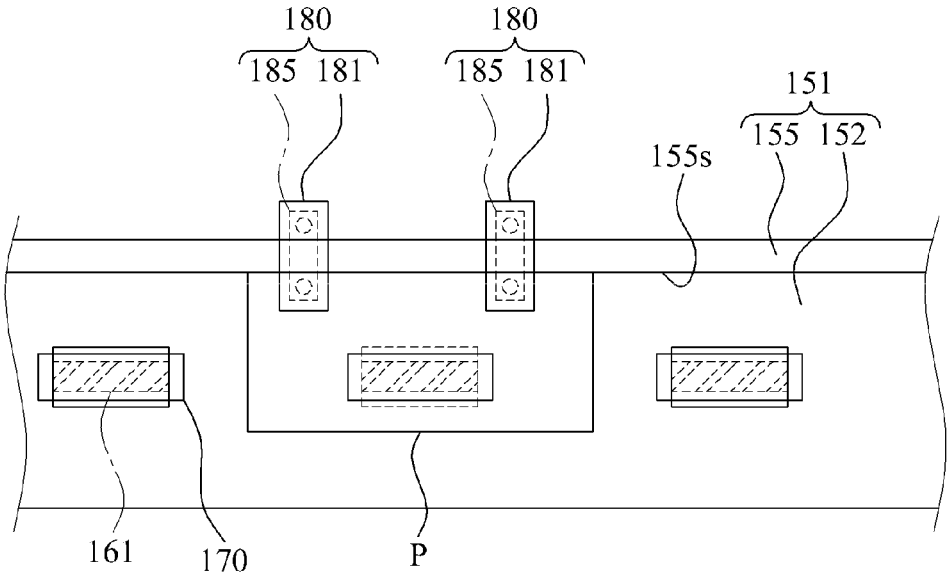

FIGS. 6A and 6B are diagrams illustrating a process of aligning a paper medium P by the alignment roller portion 160 shown in FIG. 2.

As shown in FIG. 6A, when the paper medium P introduced in the alignment body 151 have yet to be aligned and therefore the detected information is not yet generated by the at least one alignment sensor portion 180, the inclination alignment portion 175 may adjust the inclined rollers 170 to be inclined with respect to the driving rollers 161. Therefore, the paper medium P may be moved toward the alignment reference surface 155*s* of the alignment body 151 while passing through between the driving rollers 161 and the inclined rollers 170.

Conversely, as shown in FIG. 6B, when the paper medium P introduced in the alignment body 151 is aligned while passing through between the driving rollers 161 and the inclined rollers 170 and accordingly the detected information is generated by the two alignment sensor portions 180, the inclination adjustment portion 175 may rotate the inclined rollers 170 so that the inclined rollers 170 are almost in the same direction as the driving rollers 161, thereby preventing interference between the paper medium P and the alignment reference surface 155*s*.

As described above, the alignment sensor portions 180 according to the embodiment may correctly detect the aligned state and therefore reliably perform alignment of the paper medium P. In particular, a mixed paper medium including cash and checks of different sizes and types may be accurately aligned with respect to the alignment reference surface 155*s*. Therefore, correct operations including recognition of the medium may be achieved.

Hereinafter, a medium alignment apparatus according to another embodiment of the present invention will be described, omitting a description about parts substantially the same as in the medium alignment apparatus 150 of the previous embodiment.

Figure 7:
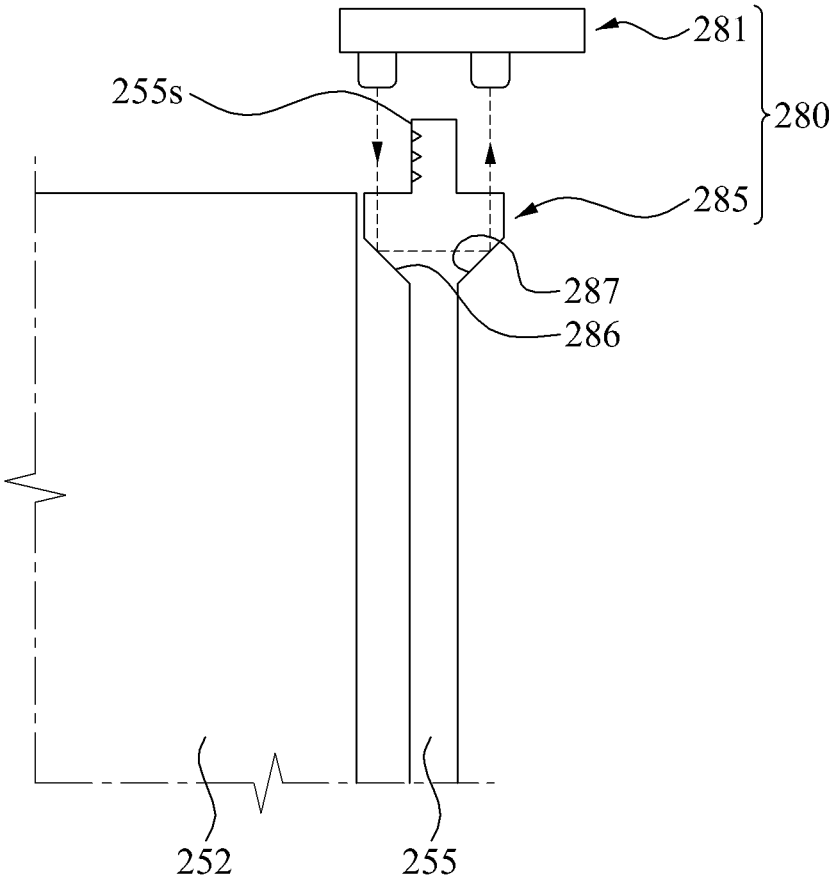
FIG. 7 is a diagram illustrating a structure of an alignment sensor portion provided to a medium alignment apparatus according to another embodiment of the present invention.

FIG. 7 is a diagram illustrating a structure of an alignment sensor portion 180 provided to a medium alignment apparatus according to another embodiment of the present invention.

Referring to the drawings, an alignment sensor portion 280 according to the present embodiment may include a transmission member 281 and a reflection member 285 in a similar manner to the previous embodiment. However, the reflection member 285 is distinctive.

The reflection member 285 may be not separately provided but integrally formed with a second body 255 which is rotatable relative to a first body 252, as shown in FIG. 7. That is, the reflection member 285 may include a first reflection surface 286 and a second reflection surface 287 disposed at a lower part of an alignment reference surface 255*s* of the second body 255. Therefore, a signal emitted from the transmission member 281 may be passed through the first reflection surface 286 and the second reflection surface 287 and received back to the transmission member 281.

However, whereas the reflection member 185 of FIG. 4 maintains a fixed state, the reflection member 285 of the present embodiment may be formed along a circumference of the second body 255 to have a longitudinal sectional shape shown in FIG. 7. Therefore, although the signal is emitted to the second body 255 rotating relative to the first body 252, transmission and reception of the signal may be accurately performed by the prism principle.

Thus, according to the present embodiment, a dedicated reflection member is dispensable since the reflection member 285 of the alignment sensor portion 280 is integrally formed with the second body 255. Consequently, the overall structure may be simplified.

According to the foregoing embodiments, completion of alignment of a paper medium is determined when detected information is obtained by two alignment sensor portions.

However, the number of the alignment sensor portions is not limited. For example, a single alignment sensor portion may determine the aligned state of the paper medium by detecting the paper medium passing through a transmission member and a reflection member for a predetermined time.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. A medium alignment apparatus comprising:

an alignment body configured to form a transfer path for passage of a medium and to include an alignment reference surface for alignment of the medium;

an alignment roller portion mounted to the alignment body to align the medium while driving the medium simultaneously; and at least one alignment sensor portion configured to detect whether the medium is aligned, by detecting a position of the medium passing along the transfer path of the alignment body, wherein the alignment body comprises:

a first body forming a transfer path for the medium and to which the alignment roller portion is mounted; and a second body disposed at one side of the first body to be movable relative to the first body at a speed corresponding to a transfer speed of the medium, while providing a side directed to the first body as the alignment reference surface.

2. The medium alignment apparatus of claim 1, wherein the first body has a cylindrical shape and the second body has a diameter greater than a diameter of the first body, thereby providing an alignment reference surface, and the second body is rotatable relative to the first body corresponding to the transfer speed of the medium.

3. The medium alignment apparatus of claim 1, wherein the at least one alignment sensor portion detects whether the medium is aligned, by receiving and transmitting a detection signal.

4. The medium alignment apparatus of claim 3, wherein the at least one alignment sensor portion comprises:

a transmission member disposed at one side of the second body providing the alignment reference surface and configured to emit the detection signal toward the alignment reference surface; and a reflection member disposed at an opposite side of the second body, facing the transmission member, with respect to the alignment reference surface and configured to reflect the detection signal.

5. The medium alignment apparatus of claim 4, wherein the second body providing the alignment reference surface includes at least one part made of a transparent material to allow passage of the detection signal of the at least one alignment sensor portion, and one of the transmission member and the reflection member is disposed at an outside and the other one-is disposed at an inside with respect to the second body providing the alignment reference surface.

6. The medium alignment apparatus of claim 5, wherein the transmission member is disposed at the outside of the second body and the reflection member is disposed at the inside of the second body.

7. The medium alignment apparatus of claim 4, wherein the reflection member is a reflecting prism configured to reflect the detection signal emitted from the transmission member back to the transmission member, and the reflection member comprises a first reflection surface to divert the detection signal emitted from the transmission member into a vertical direction and a second reflection surface to divert the detection signal reflected from the first reflection surface back to the transmission member.

8. The medium alignment apparatus of claim 7, wherein the reflection member further comprises an extension part which guides the detection signal reflected from the second reflection surface, and the extension part is extended in a direction to the transmission member.

9. The medium alignment apparatus of claim 3, wherein the at least one alignment sensor portion comprises:

a transmission member disposed at an outside of the alignment body providing the alignment reference surface and configured to emit the detection signal toward the alignment reference surface; and a reflection member integrally formed with the alignment body which faces the transmission member with respect to the alignment reference surface and configured to reflect the detection signal, wherein the reflection member is a reflecting prism configured to reflect the detection signal emitted from the transmission member back to the transmission member.

10. The medium alignment apparatus of claim 9, wherein an aligned state of the medium is detected when the detection signal emitted from the transmission member is blocked by the medium and not reflected since the medium is aligned with respect to the alignment reference surface, and a non-aligned state of the medium is detected when the detection signal emitted from the transmission member is reflected by the reflection member and received to the transmission member since the medium is not aligned with respect to the alignment reference surface.

11. The medium alignment apparatus of claim 3, wherein at least one alignment sensor portion comprises two alignment sensor portions arranged in a same direction as the transfer direction of the medium, and the medium is determined to be aligned when both of the two alignment sensors detect the medium.

12. The medium alignment apparatus of claim 1, wherein the alignment roller portion comprises:

a plurality of driving rollers disposed in the alignment body to drive the medium forward along the transfer path;

a plurality of inclined rollers disposed at an outside of the alignment body to correspond to the plurality of driving rollers, and selectively inclined with respect to a transfer direction of the medium; and an inclination adjustment portion to adjust an inclination of the plurality of inclined rollers with respect to the driving rollers based on detected information of the alignment sensor portion.

* * * * *